US007523783B2

(12) United States Patent
Victor

(10) Patent No.: US 7,523,783 B2
(45) Date of Patent: Apr. 28, 2009

(54) INTERNAL SHOCK ABSORBER PLUNGER

(75) Inventor: Bruce M. Victor, Ft. Lupton, CO (US)

(73) Assignee: Production Control Services, Inc., Frederick, CO (US)

( * ) Notice: Subject to any disclaimer, the term of this patent is extended or adjusted under 35 U.S.C. 154(b) by 235 days.

(21) Appl. No.: 11/009,997

(22) Filed: Dec. 10, 2004

(65) Prior Publication Data

US 2006/0124292 A1 Jun. 15, 2006

(51) Int. Cl.
*E21B 43/00* (2006.01)

(52) U.S. Cl. ..... 166/68; 166/105

(58) Field of Classification Search ..... 166/68, 166/105

See application file for complete search history.

(56) References Cited

U.S. PATENT DOCUMENTS

| | | | | |
|---|---|---|---|---|
| 2,147,766 | A | 2/1939 | Coberly | 103/46 |
| 2,714,855 | A | 8/1955 | Brown | 103/52 |
| 3,181,470 | A | 5/1965 | Clingman | 103/52 |
| 3,806,106 | A | 4/1974 | Hamel et al. | |
| 4,198,037 | A | 4/1980 | Anderson | |
| 4,275,790 | A | 6/1981 | Abercrombie | |
| 4,475,722 | A | 10/1984 | Paton et al. | |
| 4,502,843 | A | 3/1985 | Martin | |
| 4,712,981 | A | 12/1987 | Gramling William D. | 417/56 |
| 4,833,973 | A | 5/1989 | Wang | |
| 4,962,916 | A | 10/1990 | Palinkas | |
| 5,052,665 | A | 10/1991 | Sakuragi | |
| 5,253,713 | A | 10/1993 | Gregg et al. | |
| 5,280,890 | A | 1/1994 | Wydra | |
| 5,327,596 | A | 7/1994 | Wallace et al. | |
| 5,333,684 | A | 8/1994 | Walter et al. | 166/54 |
| 5,467,970 | A | 11/1995 | Ratu et al. | |
| 5,868,384 | A | 2/1999 | Anderson | |
| 5,957,441 | A | 9/1999 | Tews | |
| 6,148,923 | A | 11/2000 | Casey | 166/372 |
| 6,250,617 | B1 | 6/2001 | Tews | |
| 6,273,690 | B1 | 8/2001 | Fischer, Jr. et al. | |

(Continued)

FOREIGN PATENT DOCUMENTS

| | | |
|---|---|---|
| RU | 2225502 | 3/2004 |

OTHER PUBLICATIONS

Jeffrey L. Giacomino, U.S. Appl. No. 11/060,513, "Data Logger Plunger" filed Feb. 17, 2005. (No copy attached per MPEP 609.04 (a)(II)(C) because Application is stored in Image File Wrapper System.).

(Continued)

*Primary Examiner*—David J Bagnell
*Assistant Examiner*—Brad Harcourt
(74) *Attorney, Agent, or Firm*—Aileen Law; A Law Firm, P.C.

(57) ABSTRACT

A plunger mechanism has an internal shock absorber apparatus that operates to absorb shock during plunger fall and rise, thereby promoting a more reliable plunger lift system. The present apparatus can be used in well applications with or without a bumper spring. With the added reliability of the present system, well applications could be implemented such that fewer restrictions are encountered by a plunger at the well bottom. In addition, added reliability can help reduce plunger damage, whereby plunger life can be extended. Similarly, the present apparatus can minimize damage and extend the life of well components.

15 Claims, 11 Drawing Sheets

U.S. PATENT DOCUMENTS

| | | | | |
|---|---|---|---|---|
| 6,543,543 | B2 | 4/2003 | Muth | |
| 6,554,580 | B1 | 4/2003 | Mayfield et al. | |
| 6,568,477 | B1 | 5/2003 | Dveyrin | |
| 6,571,868 | B2 | 6/2003 | Victor | 166/70 |
| 6,591,737 | B2 | 7/2003 | Giacomino | 92/193 |
| 6,637,510 | B2 | 10/2003 | Lee | |
| 6,669,449 | B2 | 12/2003 | Giacomino | 417/56 |
| 6,705,404 | B2 | 3/2004 | Bosley | 166/372 |
| 6,725,916 | B2 | 4/2004 | Gray et al. | |
| 6,746,213 | B2 | 6/2004 | Giacomino | 417/56 |
| 6,907,926 | B2 | 6/2005 | Bosley | 166/108 |
| 6,945,762 | B2 | 9/2005 | Williams | 417/546 |
| 2002/0066572 | A1 | 6/2002 | Muth | |
| 2003/0141051 | A1 | 7/2003 | Abbott et al. | |
| 2003/0155129 | A1 | 8/2003 | Gray et al. | |
| 2003/0215337 | A1 | 11/2003 | Lee | |
| 2004/0129428 | A1 | 7/2004 | Kelley | 166/372 |

OTHER PUBLICATIONS

Bruce M. Victor, "Internal Shock Absorber Bypass Plunger", U.S. Appl. No. 11/010,168, filed Dec. 10, 2004; complete copy of specification, drawings, filing receipt.

Victor, Bruce M., U.S. Appl. No. 11/010,168, "Internal Shock Absorber Bypass Plunger" filed Dec. 10, 2004. Notice of Allowance and Fee(s) due mailed Jun. 27, 2007.

INTERNAL SHOCK ABSORBER PLUNGER

FIELD OF THE INVENTION

The present invention relates to a plunger lift apparatus for the lifting of formation liquids in a hydrocarbon well. More specifically the plunger consists of an internal shock absorber apparatus that operates to absorb shock during plunger fall and high velocity plunger rise.

BACKGROUND OF THE INVENTION

A plunger lift is an apparatus that is used to increase the productivity of oil and gas wells. Nearly all wells produce liquids. In the early stages of a well's life, liquid loading is usually not a problem. When rates are high, the well liquids are carried out of the well tubing by the high velocity gas. As a well declines, a critical velocity is reached below which the heavier liquids do not make it to the surface and start to fall back to the bottom exerting back pressure on the formation, thus loading up the well. A plunger system is a method of unloading gas in high ratio oil wells without interrupting production. In operation, the plunger travels to the bottom of the well where the loading fluid is picked up by the plunger and is brought to the surface removing all liquids in the tubing. The plunger also keeps the tubing free of paraffin, salt or scale build-up. A plunger lift system works by cycling a well open and closed. During the open time a plunger interfaces between a liquid slug and gas. The gas below the plunger will push the plunger and liquid to the surface. This removal of the liquid from the tubing bore allows an additional volume of gas to flow from a producing well. A plunger lift requires sufficient gas presence within the well to be functional in driving the system. Oil wells making no gas are thus not plunger lift candidates.

A typical installation plunger lift system 100 can be seen in FIG. 1. Lubricator assembly 10 is one of the most important components of plunger system 100. Lubricator assembly 10 includes cap 1, integral top bumper spring 2, striking pad 3, and extracting rod 4. Extracting rod 4 may or may not be employed depending on the plunger type. Contained within lubricator assembly 10 is plunger auto catching device 5 and plunger sensing device 6. Sensing device 6 sends a signal to surface controller 15 upon plunger 200 arrival at the well top. Plunger 200 can represent the plunger of the present invention or other prior art plungers. Sensing the plunger is used as a programming input to achieve the desired well production, flow times and wellhead operating pressures. Master valve 7 should be sized correctly for the tubing 9 and plunger 200. An incorrectly sized master valve 7 will not allow plunger 200 to pass through. Master valve 7 should incorporate a full bore opening equal to the tubing 9 size. An oversized valve will allow gas to bypass the plunger causing it to stall in the valve. If the plunger is to be used in a well with relatively high formation pressures, care must be taken to balance tubing 9 size with the casing 8 size. The bottom of a well is typically equipped with a seating nipple/tubing stop 12. Spring standing valve/bottom hole bumper assembly 11 is located near the tubing bottom. The bumper spring is located above the standing valve and can be manufactured as an integral part of the standing valve or as a separate component of the plunger system. The bumper spring typically protects the tubing from plunger impact in the absence of fluid. Fluid accumulating on top of plunger 200 may be carried to the well top by plunger 200.

Surface control equipment usually consists of motor valve (s) 14, sensors 6, pressure recorders 16, etc., and an electronic controller 15 which opens and closes the well at the surface. Well flow 'F' proceeds downstream when surface controller 15 opens well head flow valves. Controllers operate on time, or pressure, to open or close the surface valves based on operator-determined requirements for production. Modern electronic controllers incorporate features that are user friendly, easy to program, addressing the shortcomings of mechanical controllers and early electronic controllers. Additional features include: battery life extension through solar panel recharging, computer memory program retention in the event of battery failure and built-in lightning protection. For complex operating conditions, controllers can be purchased that have multiple valve capability to fully automate the production process.

FIGS. 2, 2A, 2B, 2C are side views of the upper sections of various plunger embodiments. Various existing sidewall geometries can be used in conjunction with the present apparatus.

A. Plunger mandrel 20 is shown with solid ring 22 sidewall geometry. Solid sidewall rings 22 can be made of various materials such as steel, poly materials, Teflon®, stainless steel, etc. Inner cut grooves 30 allow sidewall debris to accumulate when a plunger is rising or falling.

B. Plunger mandrel 80 is shown with shifting ring 81 sidewall geometry. Shifting rings 81 allow for continuous contact against the tubing to produce an effective seal with wiping action to ensure that all scale, salt or paraffin is removed from the tubing wall. Shifting rings 81 are individually separated at each upper surface and lower surface by air gap 82.

C. Plunger mandrel 60 has spring-loaded interlocking pads 61 in one or more sections. Interlocking pads 61 expand and contract to compensate for any irregularities in the tubing, thus creating a tight friction seal.

D. Plunger mandrel 70 incorporates a spiral-wound, flexible nylon brush 71 surface to create a seal and allow the plunger to travel despite the presence of sand, coal fines, tubing irregularities, etc.

E. Flexible plungers (not shown) are flexible for coiled tubing and directional holes, and can be used as well in straight standard tubing.

In each of FIGS. 2, 2A, 2B, 2C, an upper section of the plunger embodiment comprises a top collar shown with a standard American Petroleum Institute (API) internal fishing neck A. If retrieval is required, a spring loaded ball within a retriever and protruding outside its surface would thus fall within the API internal fishing neck at the top of the plunger, wherein the inside diameter of the orifice would increase to allow the ball to spring outward. This condition would allow retrieving of the plunger if, and when, necessary. As shown, each upper section comprises an upper end sleeve 41 and an upper threaded male section 42 used to attach various bottom ends, which will be described below.

Recent practices toward slim-hole wells that utilize coiled tubing also lend themselves to plunger systems. Because of the small tubing diameters, a relatively small amount of liquid may cause a well to load-up, or a relatively small amount of paraffin may plug the tubing.

Plungers use the volume of gas stored in the casing and the formation during the shut-in time to push the liquid load and plunger to the surface when the motor valve opens the well to the sales line or to the atmosphere. To operate a plunger installation, only the pressure and gas volume in the tubing/casing annulus is usually considered as the source of energy for bringing the liquid load and plunger to the surface.

The major forces acting on the cross-sectional area of the bottom of the plunger are:

The pressure of the gas in the casing pushes up on the liquid load and the plunger.

The sales line operating pressure and atmospheric pressure push down on the plunger.

The weight of the liquid and the plunger weight push down on the plunger.

Once the plunger begins moving to the surface, friction between the tubing and the liquid load acts to oppose the plunger.

In addition, friction between the gas and tubing acts to slow the expansion of the gas.

In certain wells, a plunger will fall towards the well bottom at a relatively high velocity. As the plunger collides with the well bottom, the spring standing valve/bottom hole bumper assembly 11, and/or the seating nipple/tubing stop 12, the impact is absorbed in part by the plunger, the spring standing valve/bottom hole bumper assembly 11, the seating nipple/tubing stop 12 and the well bottom (FIG. 1). A higher velocity could lead to greater impact force and can result in damage to the plunger, and/or the spring standing valve/bottom hole bumper assembly. Bumper springs could collapse over time due to repeated stress caused by impact force. Also, plunger damage can occur resulting in more frequent plunger replacement. Because some wells do not have a bumper spring at the bottom, more of the impact could be absorbed by the plunger itself. A plunger could also rise at a high velocity from the well bottom to the well top. This can occur when liquid levels are low or when an operator allows the plunger to lift prior to proper liquid loading. A high velocity rise could cause damage to the well top apparatus and to the plunger itself. Damage to well apparatus and plunger lift equipment typically increases well maintenance costs.

Prior art designs have utilized plungers with externally located springs to help absorb the energy generated by the plunger force hitting the well bottom. A prior solution is shown in FIG. 3, which shows prior art pad plunger mandrel 60 geometry (see FIG. 2) with a fishing neck top section A, and the addition of an external bottom spring 32 attached via weld 31. The prior art solution with such an external spring, acting as a shock absorber, tends to add reliability problems to both the plunger and well bottom assembly. Failures of the weld and/or spring can occur. In addition, a failed plunger can place more wear and tear on the well bottom seating nipple/tubing stop and spring standing valve/bottom hole bumper assembly.

SUMMARY OF THE INVENTION

The present apparatus provides a plunger lift system with a more reliable shock absorber. With more reliability, wells could be constructed with or without bumper spring assemblies, which typically operate to slow a plunger's travel. In well applications which do not utilize bumper spring assemblies, fewer obstructions or restrictions are encountered by a plunger at the well bottom. In these cases, plunger travel can be more optimal and plunger damage can be reduced or minimized.

By utilizing an internal placement of the shock absorbing components, plunger structure has less effect on the physical restrictions of a well bottom and any equipment housed therein. The present apparatus can be used if a reduction of well top damage (as in the case of high velocity plunger rise) and a reduction of well bottom damage (as in the case of high velocity plunger fall), is desired. In addition, the components of the present apparatus are easy to manufacture and easy to assemble.

The main aspect of the present invention is to provide an internal shock absorber plunger apparatus in a high liquid well when plunger falling velocity produces a large impact force at the well bottom.

Another aspect of the present invention is to provide an internal shock absorber plunger apparatus that will protect the well top apparatus and the plunger when a high velocity plunger rise occurs.

Another aspect of the present invention is to provide a spring within the plunger to function as the shock absorbing body.

Another aspect of the present invention is to allow for fewer restrictions on a well bottom.

Another aspect of the present invention is to provide a shock absorber plunger that will increase reliability levels.

Another aspect of the present invention is to provide a shock absorber plunger that will efficiently force fall inside the tubing to the well-hole bottom with increased speed without impeding plunger or well bottom damage.

Another aspect of the present invention is to provide a shock absorber plunger that can be used with any existing plunger sidewall geometry.

Another aspect of the present invention is to allow for a shock absorber plunger that can be easily manufactured.

Other aspects of this invention will appear from the following description and appended claims, reference being made to the accompanying drawings forming a part of this specification wherein like reference characters designate corresponding parts in the several views.

The present invention comprises a plunger apparatus having an internal shock absorber to increase plunger life as well as to increase life of components found at a well bottom and a well top. Although the internal shock absorber can comprise an elastomer spring, die coil spring or wave spring, other shock absorbing mechanisms can be used. An actuator rod within the plunger hits the bottom of the well and compresses the internal spring, which absorbs all or part of the impact shock.

The present invention comprises a plunger lift apparatus consisting of a top section, which is typically a standard American Petroleum Institute (API) fishing neck, or other designs; a solid core mid section allowing for various aforementioned sidewall geometries; and a lower internal shock absorber section. The lower internal shock absorber section can be designed in various ways but will basically consist of an actuator rod, a captive actuator and an internal spring. The internal spring can be a wave spring, a die coil spring, or an elastomer-type spring (i.e. Viton®, etc.), which offers excellent resistance to aggressive fuels and chemicals. One of the additional embodiments of the present invention will incorporate dual shock absorber sections, that is, a shock absorbing element at each end section, one at the top and one at the bottom of the plunger. Yet another additional embodiment will incorporate a mid-section shock absorber element.

The internal shock absorber plunger of the present invention allows for improved reliability in wells that have high fluid velocities with respect to falling plungers. It allows for fewer restrictions at the well bottom, high reliability, ease of manufacture, and incorporation of the design into existing plunger geometries.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

DETAILED DESCRIPTION OF THE INVENTION

The drawings depict an internal shock absorber plunger apparatus that can improve productivity levels in high liquid wells when plunger falling velocity produces a large impact force at the well bottom. The present apparatus can be used in well applications with or without a bumper spring. In certain wells, the rising velocity can be several times faster than a falling velocity due to well pressure conditions. As stated above, high velocity lift can occur in low liquid wells, as well as in instances when an operator will cycle the plunger prior to liquid loading. The present invention can also protect the plunger and the apparatus at the well top in the case of a high velocity lift.

Figure 1:
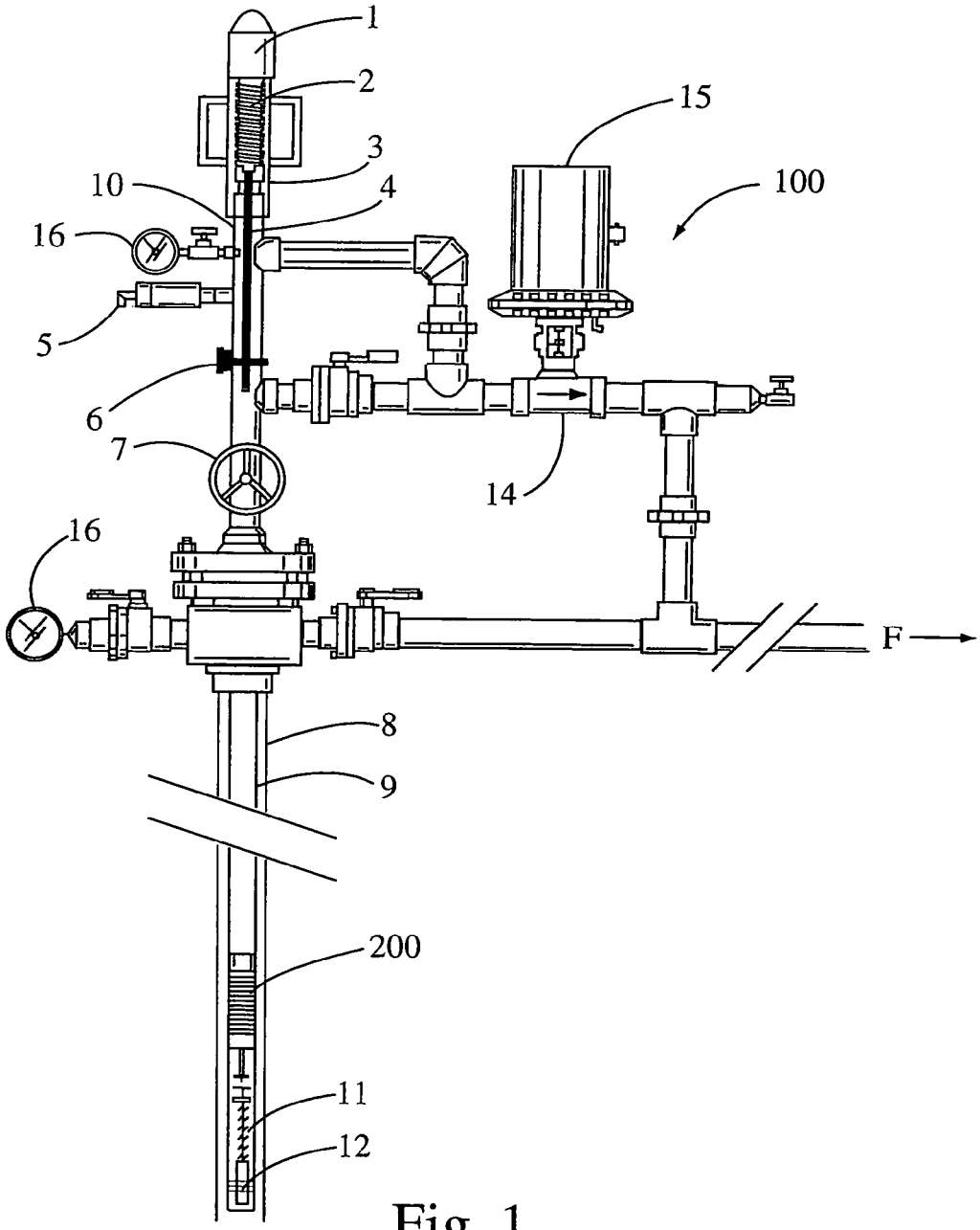
Fig. 1 (PRIOR ART)
FIG. 1 (prior art) is an overview depiction of a typical plunger lift system installation FIGS. 2, 2A, 2B, 2C (prior art) are side view depictions of the upper section of a well plunger, each having a different sidewall geometry.
Figure 2:
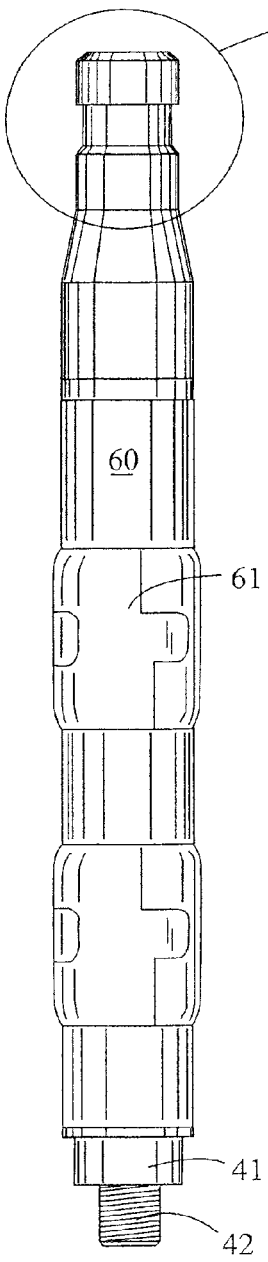
Figure 2A:
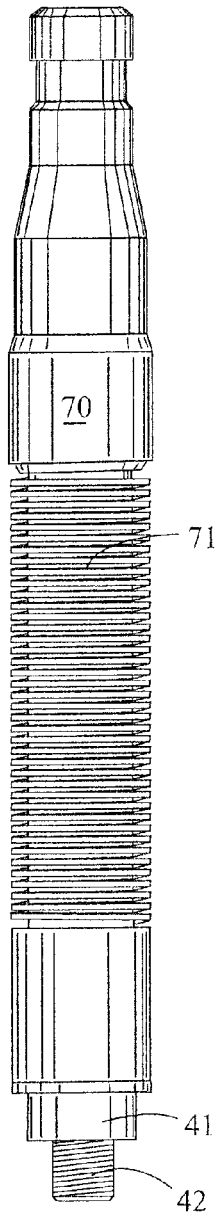
Figure 2B:
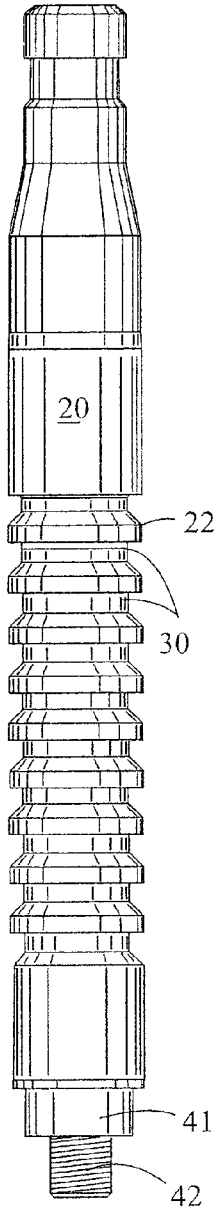
Figure 2C:
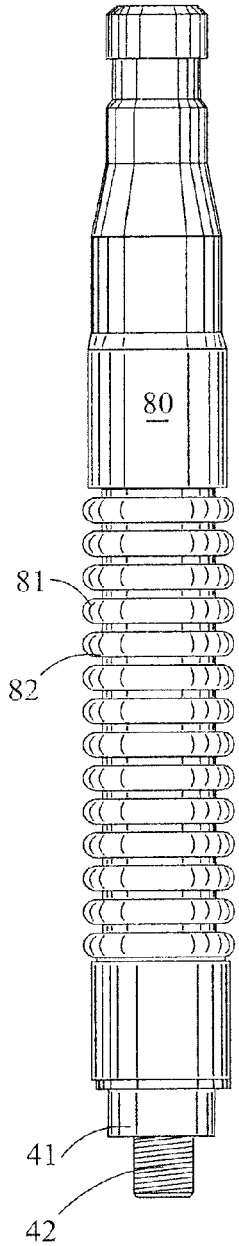
Figure 3:
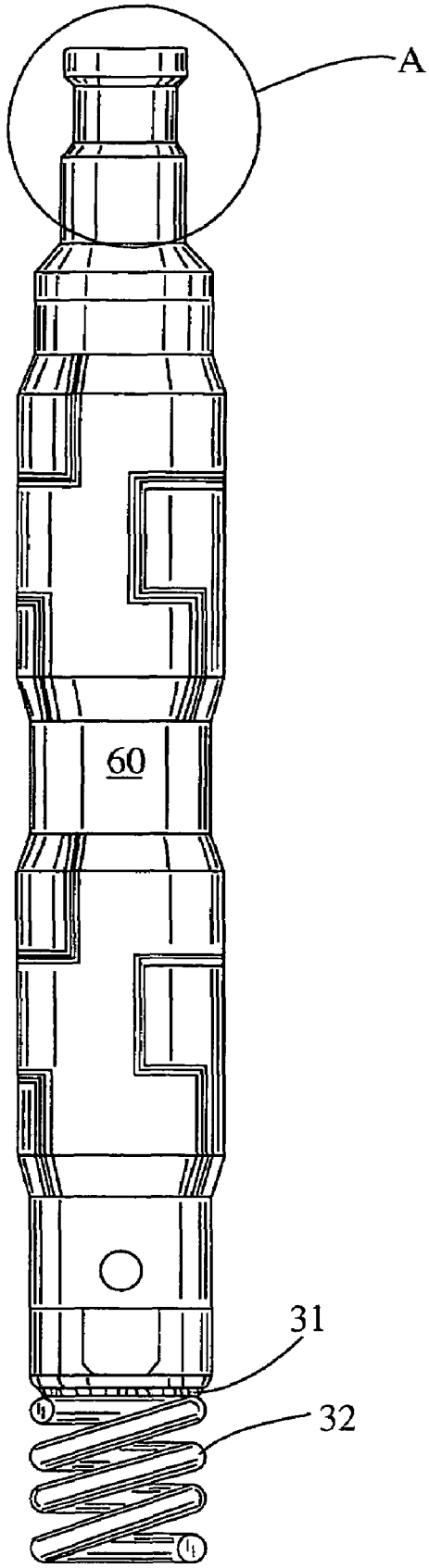
Fig. 3 ( PRIOR ART )
FIG. 3 (prior art) is a side view of pad plunger with an externally attached spring.
Figure 4:
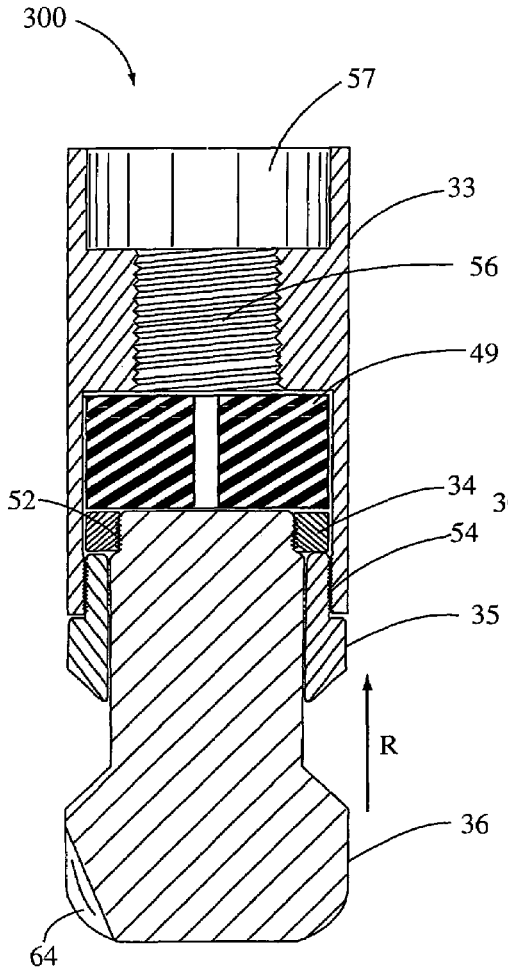
FIG. 4 is a side cross-sectional view of a lower section of an internal shock absorber embodiment using a standard die coil spring.
Figures 6, 7:
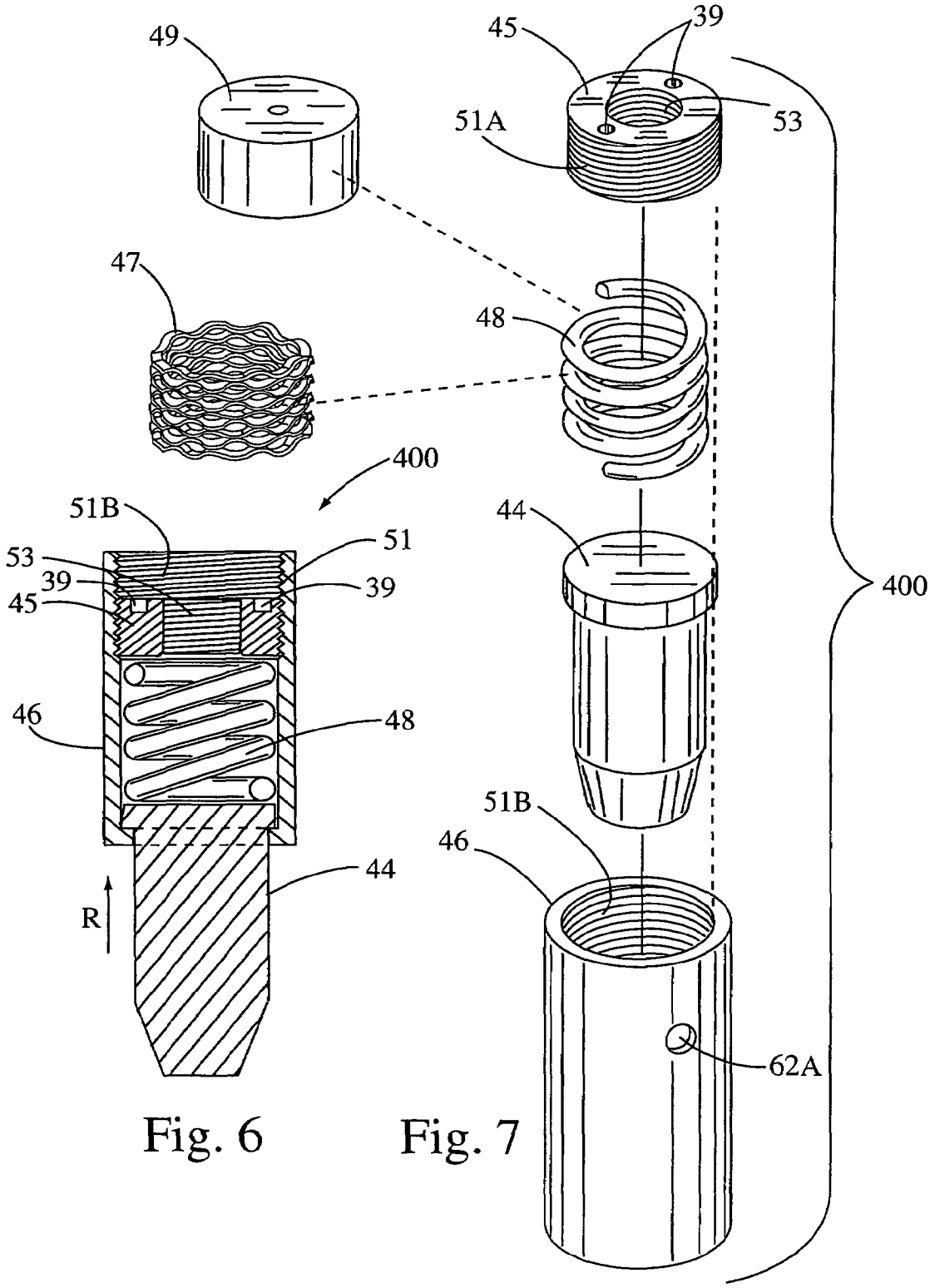
FIG. 6 is a side cross-sectional view of a lower section of the internal shock absorber plunger of an alternate embodiment using a standard die coil spring.
FIG. 7 is an isometric exploded view of the lower section of the internal shock absorber plunger embodiment shown in FIG. 6.
Figures 8, 8A, 8B, 8C:
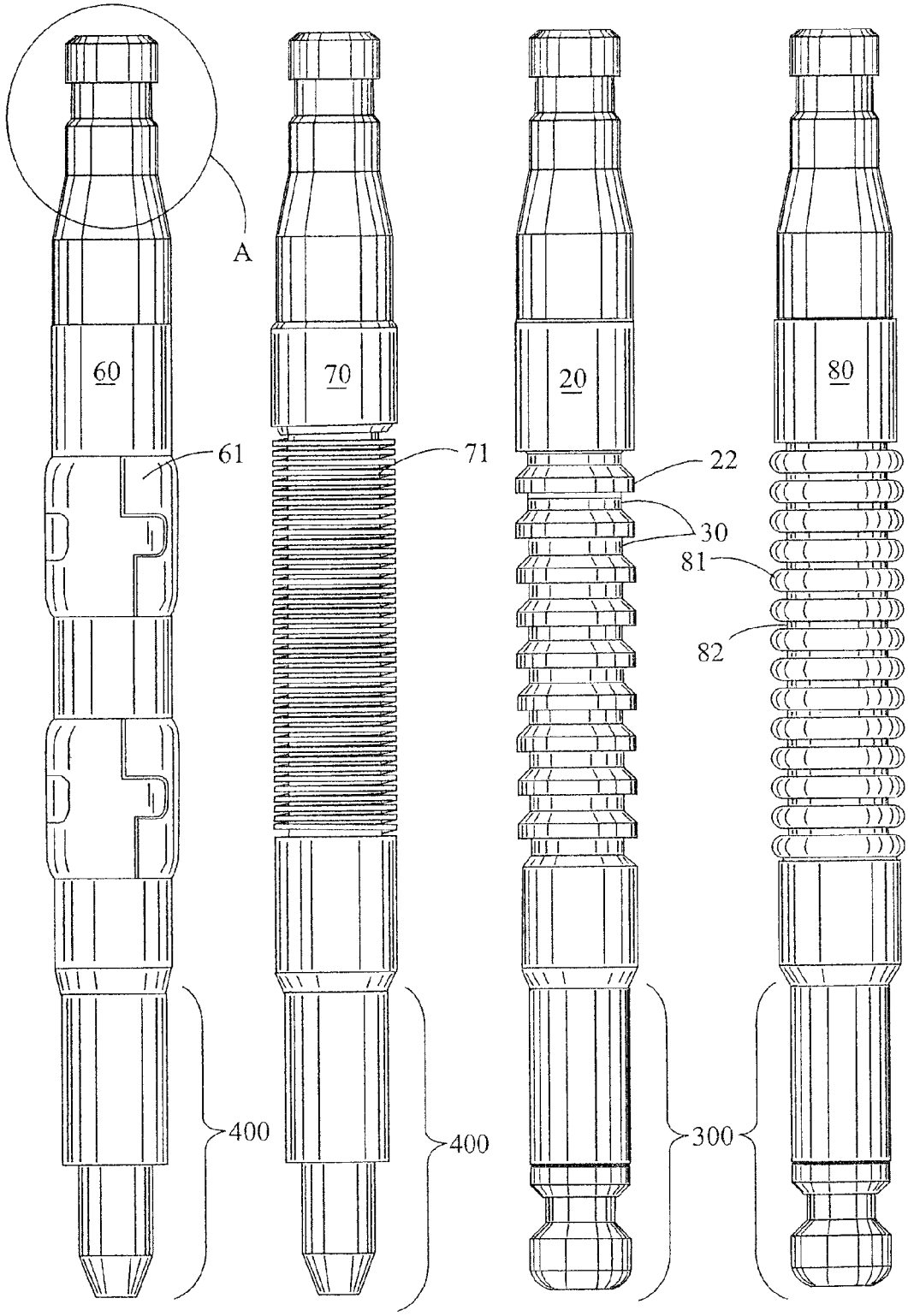
FIGS. 8, 8A, 8B, 8C are side view depictions of the internal shock absorber plunger utilizing various sidewall geometries.
Figure 9:
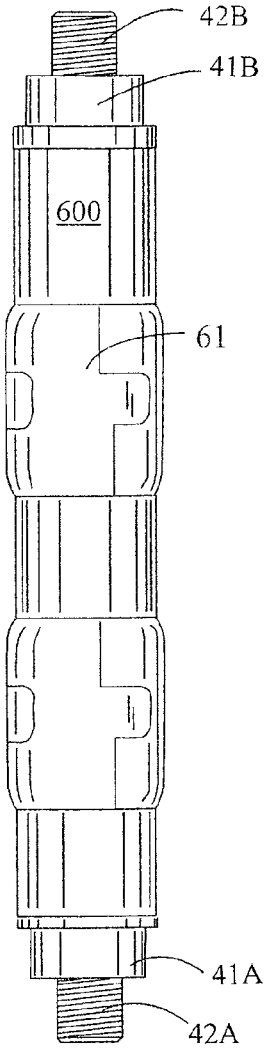
FIGS. 9, 9A, 9B, 9C are side view depictions of the central section of a dual internal shock absorber plunger embodiment shown in conjunction with existing prior art sidewall geometries.
Figure 9A:
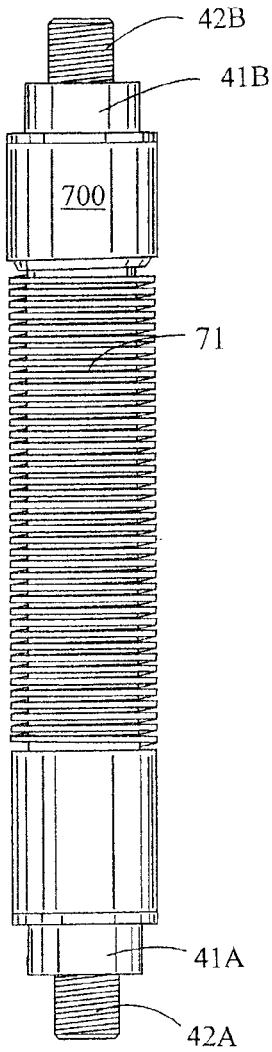
Figure 9B:
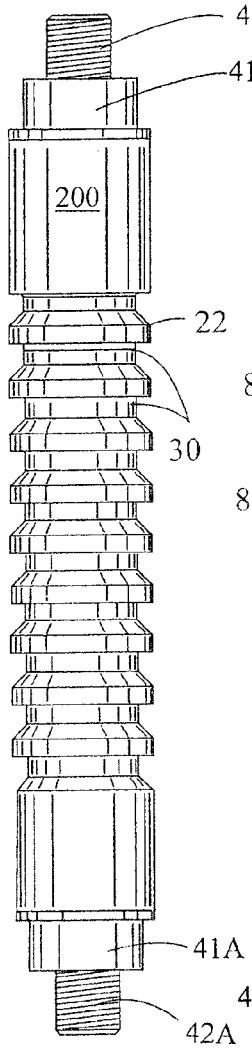
Figure 9C:
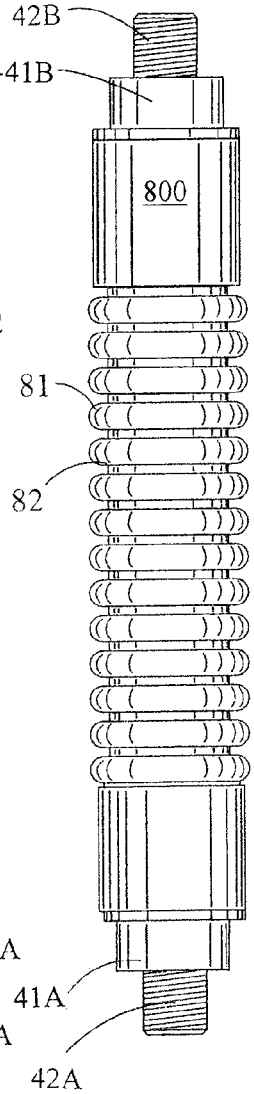

FIG. 4 shows lower removable assembly 300 of the internal shock absorber plunger housing an internal shock absorber. Lower removable assembly 300 can be added to any aforementioned geometric upper section. In this embodiment, lower removable assembly 300 comprises actuator rod (piston) 36 having external thread interface 52A, captive nut (cap) 35 having external thread interface 54A, shock absorbing elastomer spring 49, seal nut 34 having internal thread interface 52B, and case housing (cylinder wall) 33 having internal thread interface 54B at its lower end, also having an inner lower ledge to contain the upper end of shock absorbing elastomer spring 49. To mate with the upper sections shown in FIGS. 2, 2A, 2B, 2C, case housing 33 has internal cavity 57 for accepting an upper end sleeve 41. Upper threaded male section 42 (see FIGS. 2, 2A, 2B, 2C) is received by threaded female section 56. It should also be noted that shock absorbing elastomer spring 49 could be replaced with any suitable shock absorbing mechanism. For example, a shock absorbing die coil spring 48 or a shock absorbing wave type spring 47 as shown in FIG. 7) can be used. Shock absorbing elastomer spring 49 can be Viton® or any other type elastomer. Material selections can be tuned to well conditions such as temperature, falling/rising distance, resistance to fuels or chemicals present in the fluid, etc. The present invention is not limited by the type of or by the design of the internal spring.

Spanner holes (not shown) could be easily added to parts such as seal nut 34, captive nut 35, and other parts as required, to aid in fastening.

The following steps are used to describe a construction of a basic sub-assembly of lower removable assembly 300:

a) Place shock absorbing elastomer spring 49 into case housing 33;
b) Slip captive nut (cap) 35 over actuator rod 36;
c) Screw seal nut 34 onto actuator rod 36 via thread interface 52;
d) Slide actuator rod 36 with attached seal nut 34 and with captive nut 35 into case housing 33;
e) Screw captive nut 35 into case housing at thread interface 54 to complete removable assembly 300.
f) Screw lower removable assembly 300 into an upper section (see FIGS. 2, 2A, 2B, 2C) via placing internal cavity 57 onto upper end sleeve 41 and screwing threaded female section 56 to upper threaded male section 42.

When the plunger falls to the well bottom, actuator rod 36 will hit the seating bumper spring assembly that is located near the tubing bottom. In well applications having no bumper spring, the plunger will hit a hard stop at the well bottom. Both the bumper spring assembly and the internal shock absorber plunger of the present invention will absorb a portion of the force generated by the impact. If a bumper spring does not exist, impact force will be absorbed by the internal shock absorber. Upon impact, actuator rod 36 will move in direction 'R' and into shock absorbing elastomer spring 49 which will absorb a portion (or all) of the impact force. The ability of the plunger to self-absorb shock at the well bottom will thus increase reliability levels. It will reduce the probability of bumper spring collapses, reduce damage to the plunger itself, and reduce damage to the well bottom itself. It also provides the ability to have less restriction at the well bottom, that is, elimination of the need for bumper spring assemblies at the well bottom. Thus the internal shock absorber plunger will efficiently force fall inside the tubing to the well-hole bottom without impeding plunger or well bottom damage. If the plunger rises with a high velocity, the present invention provides an internal plunger shock absorption as the plunger top hits a top striking pad or other well top apparatus.

Figure 5:
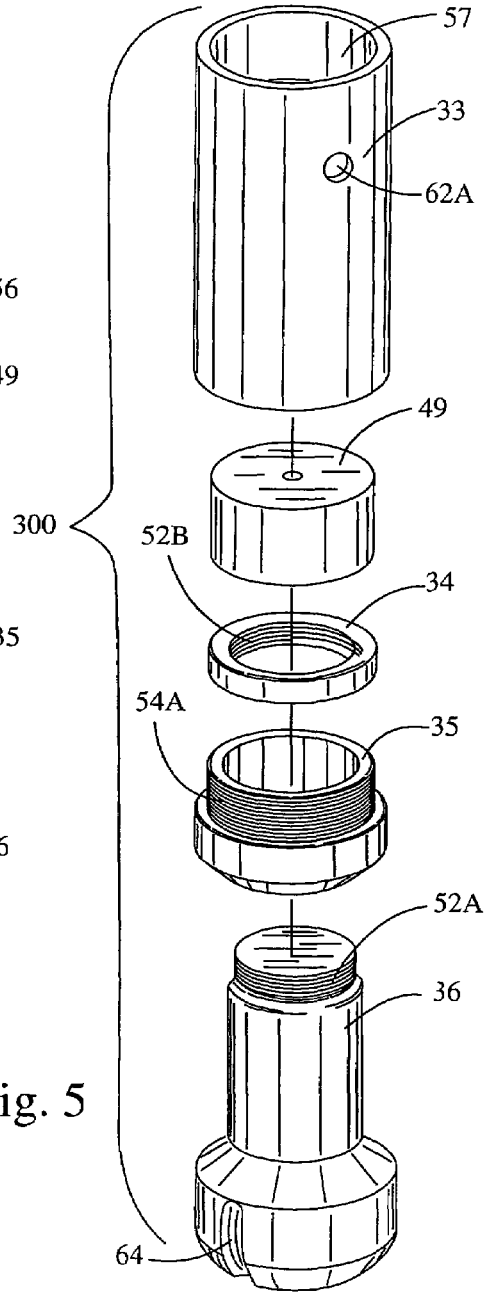
FIG. 5 is an isometric exploded view of the lower section of the internal shock absorber plunger embodiment shown in FIG. 4.

FIG. 5 is an isometric exploded view of lower removable assembly 300 of FIG. 4. It shows the basic five parts of lower removable assembly 300; actuator rod 36 has anvil B design with anvil groove 64 at one end has external thread interface 52A at its other end, captive nut 35 with external thread interface 54A, seal nut 34 with inner thread interface 52B, shock absorbing elastomer spring 49, and case housing 33. Access external hole 62A is for tightening lower removable assembly 300 to the upper section onto upper threaded male section 42. It should be noted that anvil B design could easily be replaced with other end type designs. Assembly to upper sections is completed via threaded female section 56.

FIG. 6 is an alternate embodiment of the present invention showing alternate lower removable assembly 400 of the internal shock absorber plunger containing the internal shock absorber. Here, the internal shock absorber comprises a shock absorbing die coil spring 48. Lower removable assembly 400 is an alternate design to lower removable assembly 300 shown in FIGS. 4, 5. Alternate lower removable assembly 400 can be added to any aforementioned geometric top section in the same manner as previously described herein. Alternate lower removable assembly 400 comprises actuator rod (piston) 44, shock absorbing die coil spring 48, case housing (cylinder wall) 46 with internal female housing threaded area 51B, and lock nut 45 which has internal female threaded area 53 for accepting an upper threaded male section 42, and external male threaded section 51A for mating with housing 46 via internal female housing threaded area 51B. Grip holes 39 in lock nut 45 are used to grasp and mechanically tighten lock nut 45. Actuator rod 44 has an outer flange at its upper surface to hold it within case housing 46, which has an inner flange surface on its bottom side to hold actuator rod 44 within. Shock absorbing die coil spring 48 can be replaced with a more suitable shock absorbing element. As shown in dotted line format, shock absorbing wave spring 47 or with shock absorbing elastomer-type spring 49 could be used. The present invention is not limited by the spring type or by the spring design.

When the plunger falls to the well bottom, actuator rod 44 will hit the seating bumper spring assembly or hit a hard stop at the well bottom. Upon impact, actuator rod 44 will move in direction 'R' and into shock absorbing coil spring 48 which will absorb a portion (or all) of the impact force. Likewise, when a plunger rises to the well top with a high velocity, damage is avoided as the top of the plunger hits well top apparatus and the internal shock absorbing coil spring 48 will absorb a portion (or all) of the impact force.

FIG. 7 is an isometric blow-up view of lower removable assembly 400 of FIG. 6. Lower removable assembly 400 consists of actuator rod (piston) 44, die coil spring 48, case housing 46, and lock nut (threaded cap) 45 with internal female threaded area 53 for accepting upper threaded male section 42 (see FIGS. 2, 2A, 2B, 2C), and outside male threaded area 51A for mating with housing 46 which has internal female housing threaded area 51B. Grip holes 39 are used to grasp and mechanically tighten lock nut 45. As previously discussed, shock absorbing die coil type spring 48 can also be replaced with shock absorbing wave spring 47 or with an elastomer-type spring 49. Access external hole 62B is for tightening lower removable assembly 400 to the upper section onto upper threaded male section 42.

Viewing FIG. 7 it can be seen that this embodiment basically consists of four parts in lower removable assembly 400; actuator rod 44, shock absorbing die coil spring 48, case housing 46 with internal female housing threaded area 51B, and lock nut 45 with inside female threaded area 53 for accepting upper threaded male section 42 (see FIGS. 2, 2A, 2B, 2C), and outside male threaded area 51A for mating with inner female threaded area 51B on case housing 46. As previously discussed, shock absorbing die coil type spring 48 can also be replaced with any suitable shock absorbing element such as a shock absorbing wave spring 47 or a shock absorbing elastomer-type spring 49. Assembly to upper sections is also via a simple thread at threaded interfaces 51, 53.

It should be noted that although both removable assemblies have been shown with upper female type receptacles and upper plunger sections have been shown with lower male type sections for joining each other, other designs could easily be employed to have removable assemblies with male upper sections and female upper plunger sections with female lower sections for mating.

FIGS. 8, 8A, 8B, 8C are side views of the internal shock absorber plunger utilizing various sidewall geometries (including but not limited to mandrel geometries 22, 61, 71, 81). For illustrative purposes, lower removable assembly 300 is shown in conjunction with plunger mandrel 20 having solid ring 22 geometry (see FIG. 8B) and plunger mandrel 80 having shifting ring 81 geometry (see FIG. 8C). Lower removable assembly 400 is shown in conjunction with plunger mandrel 60 (see FIG. 8) and plunger mandrel 70 (see FIG. 8A). It should be noted that the present invention is not limited to any specific sidewall geometry and that any sidewall geometry can be used.

Although any top geometry can readily be used with the present invention, a standard American Petroleum Institute (API) internal fishing neck top A is shown in FIGS. 8, 8A, 8B, 8C.

A dual internal shock absorber embodiment is shown in FIGS. 9, 9A, 9B, 9C, 10, 11, 12, 13. 'Dual shock absorbing sections can provide for additional shock absorption. This embodiment can be constructed by adding a second shock absorbing upper assembly to a first shock absorbing assembly. The additional shock absorbing assembly can allow for improved internal shock absorption as needed based on well conditions.

Figure 10:
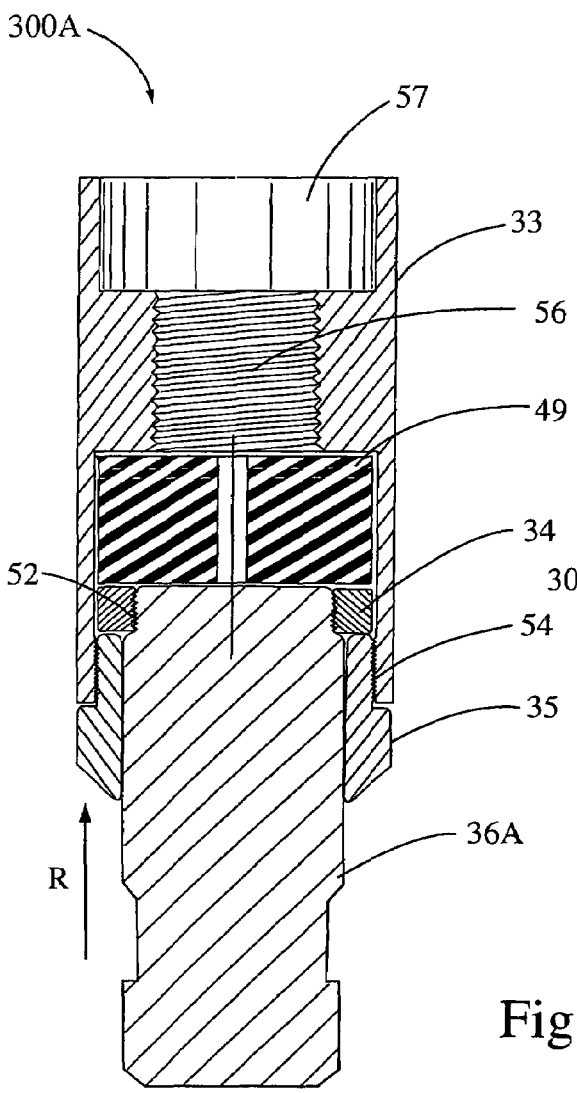
FIG. 10 is a side cross-sectional view of an upper assembly for an embodiment comprising a dual internal shock absorber.
Figure 11:
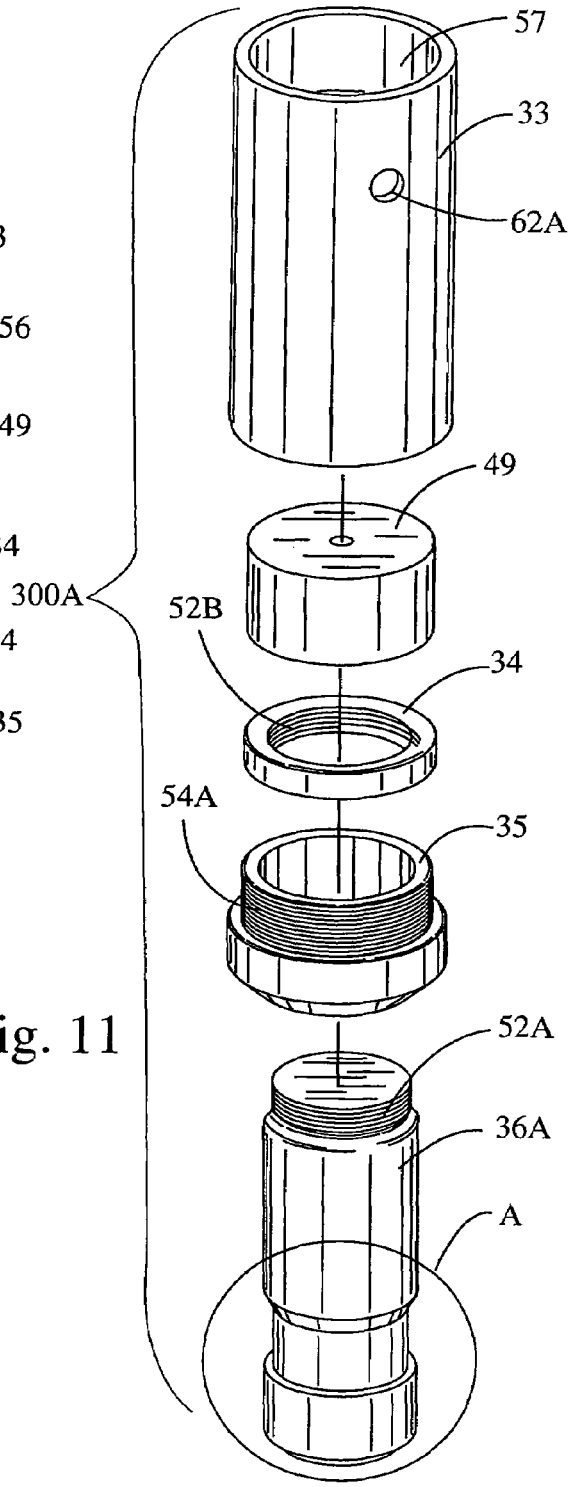
FIG. 11 is an isometric exploded view of the upper shock absorbing assembly of FIG. 10 for the dual internal shock absorber.

FIGS. 9, 9A, 9B, 9C are side view depictions of the section between sleeves 41A, 41B of a dual internal shock absorber plunger embodiment shown in conjunction with existing prior art sidewall geometries. As compared to FIGS. 2, 2A, 2B, 2C, this embodiment comprises end sleeves 41A, 41B and threaded male sections 42A, 42B for accepting more than one shock absorber assembly. All geometries depicted can be found in present industrial offerings. Similar geometries also exist and will have internal orifices. FIGS. 10, 11 as described below, depict a shock absorbing section embodiment that can be added to sleeve end 41B via screwing onto upper threaded male section 42B. Each mandrel central section 600, 700, 200, 800 is symmetrically designed to hold both an upper shock absorbing assembly 300A or 400A (FIGS. 10, 11, 12, 13) and a lower shock absorbing assembly 300 or 400 (FIGS. 4, 5, 6, 7).

FIG. 10 shows upper shock absorbing assembly 300A for the dual internal shock absorber housing an elastomeric spring 49. Elastomeric spring 49 can be replaced with other type springs such as a wave spring or a die coil spring. All elements of FIG. 10 are as described in FIG. 4 with the exception that actuator rod 36A comprises a fishing neck A design. Upper shock absorbing assembly 300A mates with central section 600, 700, 200, 800 (see FIGS. 9, 9A, 9B, 9C) via internal cavity 57 for accepting end sleeve 41B and threaded male section 42B is received by threaded female section 56. Threaded female section 56 of a lower shock absorbing assembly 300 or 400 can receive threaded male section 42A. Internal cavity 57 may accept end sleeve 41A. Thus, upper assembly 300A provides for a second shock absorbing assembly forming a dual internal shock absorbing plunger embodiment.

FIG. 11 is an isometric exploded view of the upper shock absorbing assembly 300A of FIG. 10. All parts of removable assembly 300A are as previously described in FIG. 5 above with the exception that actuator rod 36A has fishing neck A design for retrieval purposes.

Figures 12, 13:
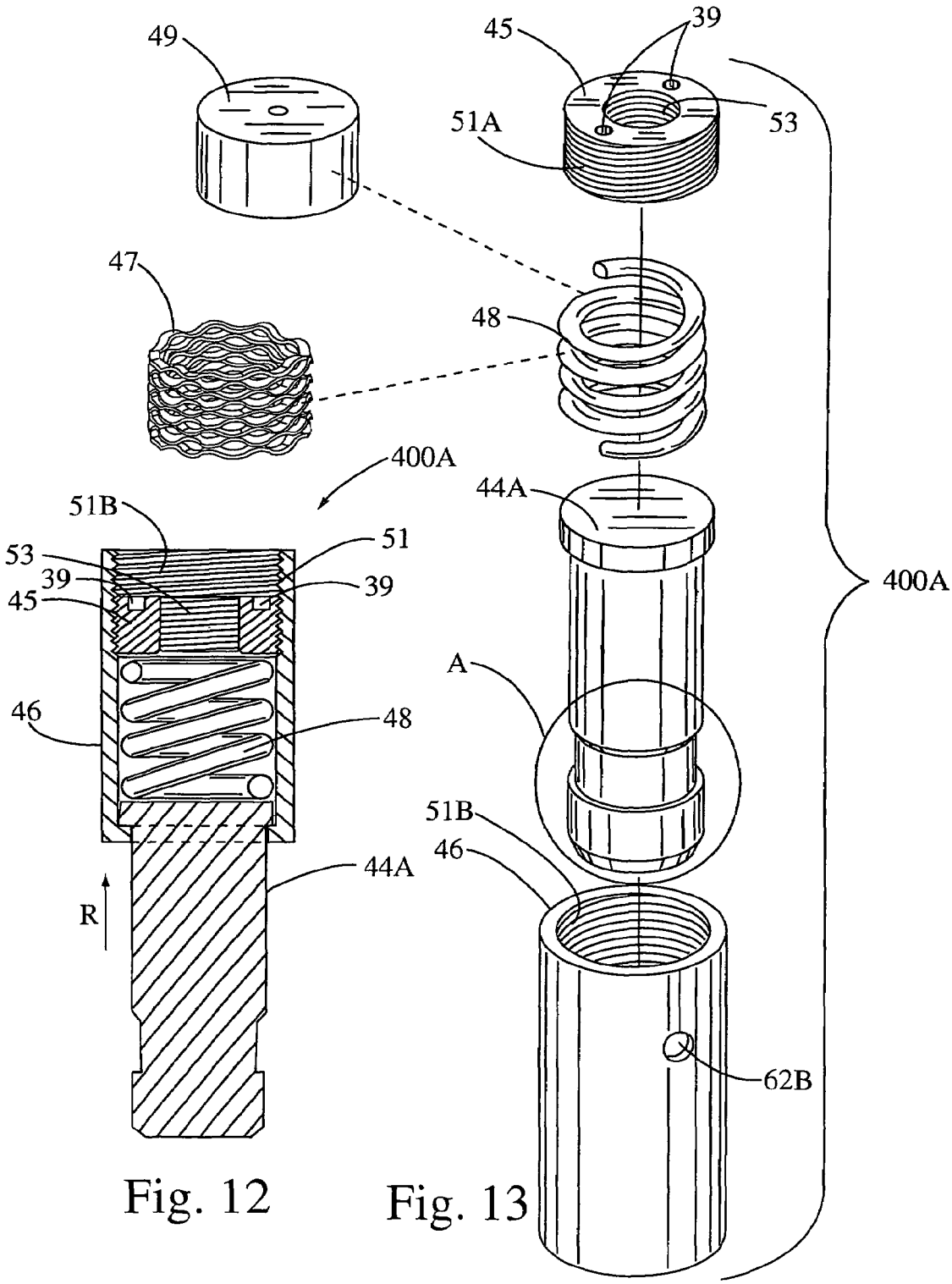
FIG. 12 is a side cross-sectional view of an alternate embodiment of an upper shock absorbing assembly for a dual internal shock absorber plunger.
FIG. 13 is an isometric exploded view of the upper shock absorbing assembly of FIG. 12 for the dual internal shock absorber plunger.

FIG. 12 is a side cross-sectional view of an alternate embodiment 400A of an upper assembly for a dual internal shock absorber plunger. Upper assembly 400A is an alternate design to upper assembly 300A shown in FIG. 10. All elements of FIG. 12 are as described in FIG. 6 with the exception that actuator rod 44A has fishing neck A design. In addition, the present embodiment houses a shock absorber element comprising a die coil spring 48. As stated above, any suitable shock absorbing element could be used. Upper shock absorbing assembly 400A mates with central section 600, 700, 200, 800 via internal threads 53 for accepting threaded male section 42B (see FIGS. 9, 9A, 9B, 9C). Upper assembly 400A provides for a second shock absorbing assembly forming a dual internal shock absorbing plunger.

FIG. 13 is an isometric exploded view of upper shock absorber assembly 400A shown in FIG. 12. All parts of removable assembly 400A are as previously described in FIG. 7 above with the exception that actuator rod 44A has fishing neck A design for retrieval purposes.

Figure 14:
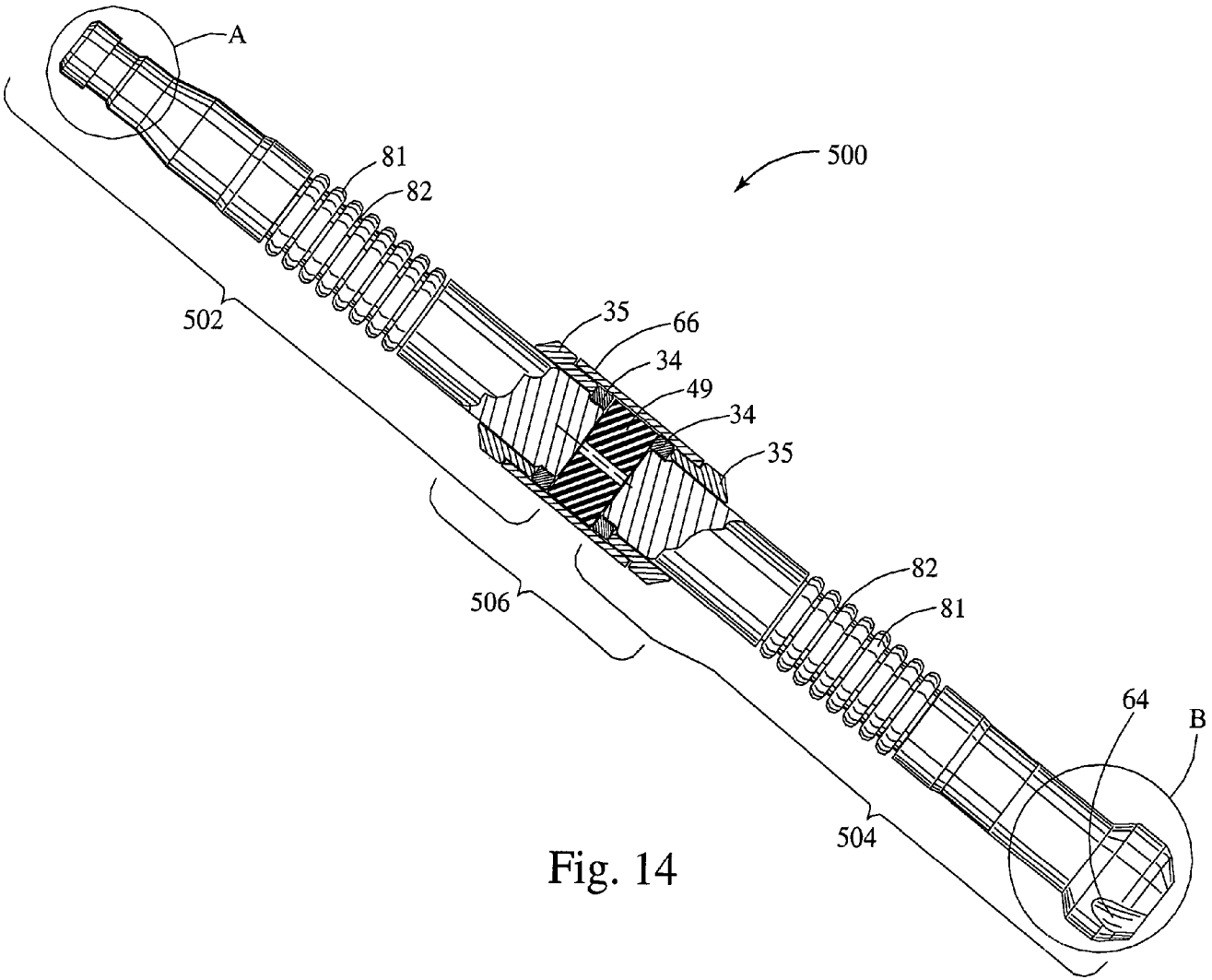
FIG. 14 is side view, including a mid-section cross-sectional view, of an internal shock absorber plunger embodiment having a shock absorbing mid-section.

FIG. 14 is a side view, including a mid-section cross-sectional view, for a mid-section internal shock absorber plunger 500 embodiment. For a rising plunger condition, upper mandrel section 502 will hit the well top and for a falling plunger condition, lower mandrel section 504 will hit the well bottom. In either case a shock absorber such as elastomer spring 49 will absorb some or all of the impact energy. In this embodiment, casing assembly 506 houses mid-section casing 66 having threaded interfaces at either ends, one internal elastomer spring 49, two captive nuts 34 for attaching upper mandrel 502 and lower mandrel 504, and two captive nuts 35 for containing both mandrel sections. Shock absorbing elastomer spring 49 could be replaced with any suitable shock absorbing mechanism. For example, a shock absorbing die coil spring 48 or a shock absorbing wave type spring 47 (as shown in FIG. 7) can be used.

At an upper end, upper mandrel section 502 comprises a fishing neck A design, while lower mandrel section 504 comprises an anvil B end design as previously shown in FIGS. 4, 5, 8, 8A, 8B, 8C. In this example, mandrel sections 502, 504 are shown with shifting ring geometry. Shifting rings 81, are individually separated by air gaps 82. It should be noted that although a shifting ring geometry is shown, other previously described sidewall geometries could also be used.

Figure 15:
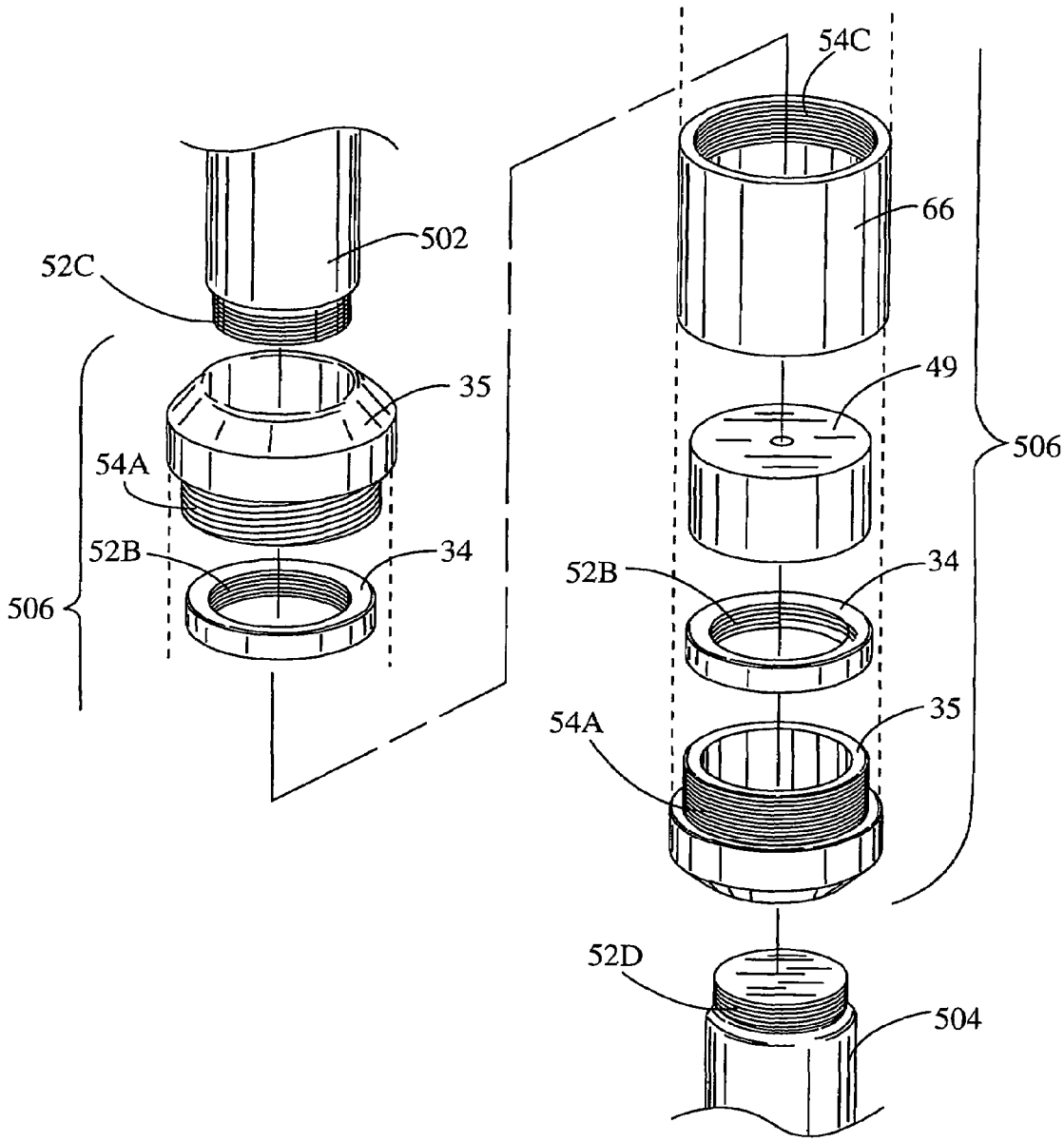
FIG. 15 is an isometric exploded view of the casing assembly of a mid-section internal shock absorber plunger.

FIG. 15 is an isometric exploded view of casing assembly 506. Assembly of this plunger embodiment can be described as follows:

a) Slide upper mandrel 502 thru upper captive nut 35 and thread upper seal nut 34 onto it via seal nut threads 52B mating to upper mandrel threads 52C.

b) Slide lower mandrel 504 thru lower captive nut 35 and thread lower seal nut 34 onto it via seal nut threads 52B mating to lower mandrel threads 52D.

c) Place elastomer spring 49 into casing 66.

d) Thread upper captive nut 35 via threads 54A onto casing 66 via upper casing threads 54C, thereby securing upper mandrel 502 to casing 66.

e) Thread lower captive nut 35 via threads 54A onto casing 66 via lower casing threads 54C (not shown), thereby securing lower mandrel 504 to casing 66, thus completing assembly of the mid-section internal shock absorber plunger third embodiment of the present invention.

The present invention can optimize well efficiency and plunger reliability. An internal shock absorber allows the present apparatus to quickly travel to the well bottom, or to quickly travel to the well top, while reducing damage caused by a forcible impact of the plunger against various well components. Thus, the internal shock absorber plunger can increase plunger life (by reducing plunger damage) as well as the life of components found at a well top and well bottom. The internalized design can also result in a well application with fewer restrictions at the well bottom. With the present apparatus, wells could be operated without equipment such as a bumper spring assembly, if desired. The internal shock absorber can utilize any suitable shock absorbing element to absorb all or part of the impact shock. Examples of such could include elastomer springs, die coil springs, wave springs, etc.

It should be noted that although the hardware aspects of the of the present invention have been described with reference to the exemplary embodiment above, other alternate embodiments of the present invention could be easily employed by one skilled in the art to accomplish the internal shock absorber aspect of the present invention. For example, it will be understood that additions, deletions, and changes may be made to the internal shock absorber plunger with respect to design, shock absorber mechanisms (such as spring types etc.), plungers with bypass functions, geometric designs other than those described above (snake plungers etc.), and various internal part designs contained therein.

Although the present invention has been described with reference to preferred embodiments, numerous modifications and variations can be made and still the result will come within the scope of the invention. No limitation with respect to the specific embodiments disclosed herein is intended or should be inferred.

I claim:

1. A plunger comprising:

an elongate body having an upper end, a lower end and a central assembly;

each of said upper and lower ends further comprising a slidable piston;

said central assembly further comprising a cylindrical housing supporting an internal shock absorbing element positioned between the slidable pistons; and wherein a falling or a rising of the plunger results in the plunger's impact with a well stop causing a portion of each of said slidable pistons to contact an end of the internal shock absorbing element, said shock absorbing element capable of absorbing a portion of an impact force created by the plunger striking the well stop.

2. The plunger of claim 1, wherein the internal shock absorbing element is a spring.

3. The plunger of claim 1, wherein the internal shock absorbing element is elastomer.

4. The plunger of claim 1, wherein the cylindrical housing of the central assembly further comprises an upper and a lower threaded end.

5. The plunger of claim 1, wherein the upper end further comprises a fishing neck design.

6. The plunger of claim 1, wherein the cylindrical housing of said central assembly further comprises an upper and a lower end, each end capable of receiving a cap for supporting the internal shock absorbing element in said cylindrical housing.

7. The plunger of claim 6, wherein each of said slidable pistons further comprises a male tlreaded end mateable with a female end of each of said caps.

8. A plunger comprising:

an elongate body having an upper end, a lower end and a central assembly;

each of said upper and lower ends further comprising a slidable piston;

said central assembly further comprising a cylindrical housing supporting an internal shock absorbing means located between the slidable pistons said shock absorbing means functioning to absorb a portion of an impact force created by the plunger striking a well stop; and wherein the impact force created by the plunger striking the stop causes a portion of each of said slidable pistons to deform the internal shock absorbing element.

9. A plunger comprising:

a mandrel having an upper end and a lower end;

said upper end or said lower end further comprising a detachable cylinder;

said detachable cylinder housing an internal shock absorber mounted in series with an end of a unitary piston rod, a portion of said unitary piston rod residing within the boundary of said cylinder;

a remainder of said unitary piston rod protruding beyond an outermost edge of said cylinder; and a lockable nut mateable with a threaded surface on an interior wall of said cylinder to secure said unitary piston rod to said cylinder.

10. The apparatus of claim 9, wherein said detachable cylinder is sealed to prevent fluids from a well environment to make contact with said internal shock absorber.

11. A internal shock absorber assembly for a plunger comprising:

a unitary slidable piston having a threaded interface to mate with a captive nut and a seal nut and thereby form a subassembly;

said subassembly slidable into an end of a case housing to be mounted end to end with a shock absorber element housed within said case housing;

a portion of said unitary piston protruding beyond an outermost edge of said case housing; and wherein said captive nut of said subassembly mates with a threaded interface located on an interior wall surface of said case housing to secure said subassembly to said case housing; and means for connection to an end of a plunger mandrel.

12. The apparatus of claim 11, wherein said case housing is sealed to prevent fluids from a well environment to make contact with said shock absorber element.

13. A internal shock absorber assembly for a plunger comprising:

an actuator rod having a flanged end and a tapered end, said tapered end slidable into an end of a case housing, a flange capable of securing said flanged end in said case housing, said tapered end of said actuator rod protruding beyond an outermost edge of said case housing;

a shock absorber element mounted adjacent said flanged end of said actuator rod;

a lockable nut mounted in series with said shock absorber element and mateable with a threaded surface on an interior wall of said case housing to secure said shock absorber element and said flanged end in said case housing; and means for connection to an end of a plunger mandrel.

14. The assembly of claim 13, wherein said flange seats on a internal ledge of said case housing.

15. The apparatus of claim 13, wherein said case housing is sealed to prevent fluids from a well environment to make contact with said shock absorber element.

* * * * *